United States Patent [19]

Pase

[11] 3,951,278

[45] Apr. 20, 1976

[54] APPARATUS FOR UNLOADING BULK MATERIAL

[75] Inventor: Hugh H. Pase, Cheshire, Conn.

[73] Assignee: Mimco Incorporated, Cheshire, Conn.

[22] Filed: Nov. 6, 1974

[21] Appl. No.: 521,514

Related U.S. Application Data

[62] Division of Ser. No. 307,445, Nov. 17, 1972, Pat. No. 3,865,347.

[52] U.S. Cl. ..... 214/44 R; 74/105

[51] Int. Cl.[2] ..... B65G 67/24

[58] Field of Search ..... 214/44 R, 83.28; 198/53 A; 74/102, 105

[56] References Cited

UNITED STATES PATENTS 3,055,315 9/1962 Dorey ..... 74/105 X 3,528,570 9/1970 Pase ..... 214/44 R

*Primary Examiner*—Robert G. Sheridan

[57] ABSTRACT

A device for mechanically connecting hopper car unloading boots to the discharge outlets on the car for unloading bulk material from the car, in which a pair of coupling frames are supported on a lift platform and interlinked with each other so that they can be spread apart into position under the outlets on the car and drawn together between the tracks by moving either one of the coupling frames, such movement automatically resulting in the other coupling frame being moved a corresponding amount in the opposite direction. In addition the lift platform is prevented from accidentally lowering out of engagement with the outlets by a hydraulic lock that is built into the lift cylinder.

4 Claims, 6 Drawing Figures

APPARATUS FOR UNLOADING BULK MATERIAL

This application is a division of application, Ser. No. 307,445 filed Nov. 17, 1972, now U.S. Pat. No. 3,865,347.

BACKGROUND OF THE INVENTION

The present invention relates to apparatus for unloading bulk, material-carrying cars such as railroad hopper cars and the like, and it relates more particularly to improvements in unloading apparatus of the type shown in my prior U.S. Pat. No. 3,528,570 granted Sept. 15, 1970, wherein a movable platform is supported on the free ends of lifting arms which are pivoted to a fixed frame at the unloading station. One end of a boot or tubular chute for receiving the material as it flows from the outlet of the car is fastened to the platform, so that when the lifting arms are swung upwardly by a power cylinder the movable platform and boot are raised into engagement with the discharge outlet of the car in order to connect the boot thereto and to hold it in sealing engagement therewith.

In installations of this type which are designed to receive material from hopper cars having dual discharge outlets, a pair of coupling frames are supported on the lift platform so that they can move horizontally into alignment with the outlets on the cars before being raised into engagement with them. The present invention provides an improved way of moving the coupling frames into alignment with these outlets.

An object of the invention is to make the two coupling frames move in unison in opposite directions so that when one is moved, either manually or by a power cylinder, the other will move a corresponding amount in the opposite direction.

SUMMARY OF THE INVENTION

The spreading device of the present invention includes a spreader bar pivoted intermediate its ends to the lift platform between the two coupling frames, to which it is pivotally connected adjacent its ends by links, so that movement of either coupling frame results in a corresponding movement of the other in the opposite direction.

DESCRIPTION OF PREFERRED EMBODIMENT

The invention is illustrated in the accompanying drawings wherein

Figure 1:
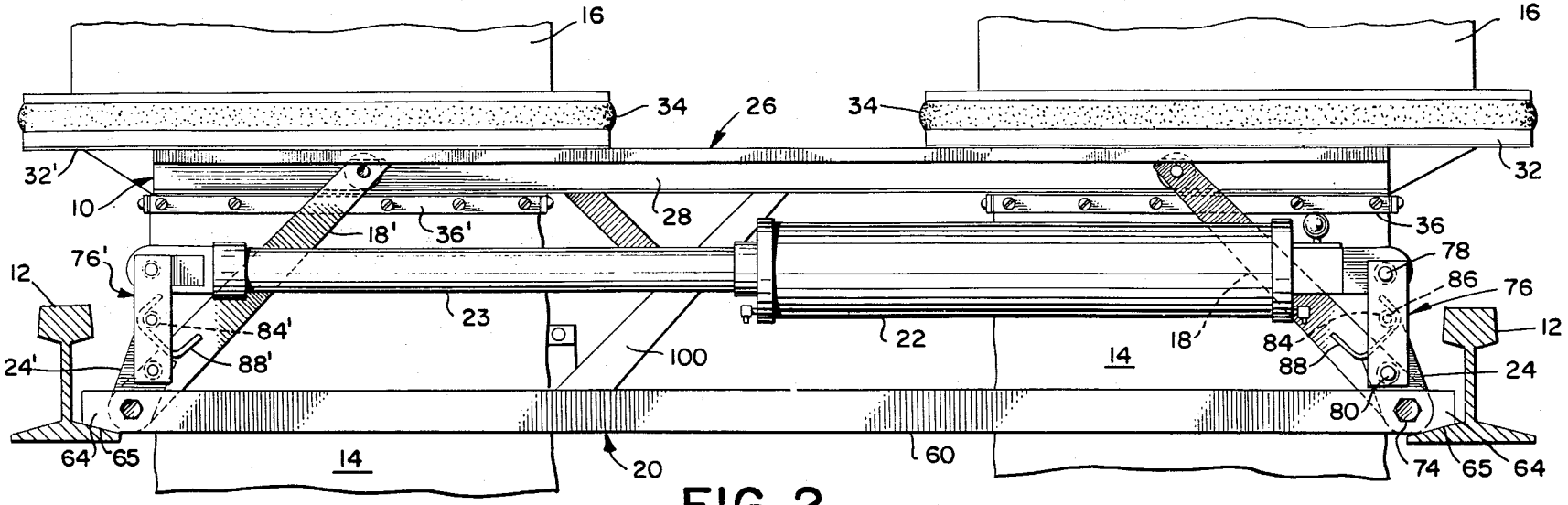
FIG. 1 is a side elevation of a bulk unloading apparatus in which the coupling-frame spreader of the present invention may be employed and showing the boot-connecting assembly elevated into full engagement with the discharge outlets on the underside of a railroad hopper car.

As in the case of the unloader shown in my prior U.S. Pat. No. 3,528,570, the present apparatus is designed for use in unloading railroad hopper cars, but the invention is not limited to such use. The unit consists essentially of a lift platform or boot-connecting assembly 10, which is raised from a retracted position between the rails of a railroad track 12 and substantially flush therewith, to an extended position above the track for connecting the upper ends of a pair of unloading boots 14, 14 with a pair of discharge outlets 16, 16 (FIG. 1) at the bottom of the hopper of a railroad car (not shown). The boot-connecting assembly is supported on the free ends of two pairs of oppositely disposed lifting-arms 18, 18 and 18′, 18′, respectively, which are pivotally mounted on a fixed frame 20 between the rails of track 12. Lifting-arms 18, 18 are pivoted adjacent one of the rails and extend inwardly toward the opposite pair of lifting-arms 18′, 18′, which are pivoted adjacent the other rail so that they extend inwardly toward arms 18, 18.

A power cylinder 22, having a piston rod 23, is hinged at its opposite ends to a pair of crank-arms 24, 24′, one of which is rigidly connected to one pair of lifting-arms 18, 18 and the other to the opposite pair of lifting-arms 18′, 18′. Extension of power cylinder 22 causes the lifting-arms to pivot upward lifting boot-connecting assembly 10, while retraction of power cylinder 22 permits the lifting-arms to pivot downward lowering the boot-connecting assembly, in substantially the same manner as the unloader shown and described in my aforementioned patent.

The boot-connecting assembly 10 consists in this instance of a platform or H-frame 26 having two parallel channel members 28, 28 rigidly connected at their centers, by a cross-piece 30, which is formed of upper and lower plates 31, 31′ (FIG. 4) spaced vertically from each other and welded at both ends to the inner sides of channels 28, 28. A pair of rectangular, hollow coupling frames 32, 32′ are slidable supported on H-frame 26 for movement transversely of track 12. The upper surfaces of coupling frame 32, 32′ are lined with thick sponge rubber gaskets 34 for sealing the connection between the coupling frames 32, 32′ and the flanges surrounding the discharge outlets 16 of the hopper car. The upper end of each boot 14, 14 is fastened to the lower edge of a flange 36, 36′ on the underside of each coupling frame 32, 32′. The lower ends of boots 14, 14 are suitably clamped to the openings in the receptacle (not shown) for the material.

As in my prior design, the two coupling frames 32, 32′ are provided with means for spreading them apart after the boot-connecting assembly 10 has been raised above the track 12 by lift arms 18, 18′. In accordance with the present invention, a simplified system for doing this has been devised in order to save expense and to make it possible to position both frames 32, 32′ manually simply by moving one or the other into alignment with the discharge opening on either side of the car to be unloaded. To this end, a spreader bar 38

(FIGS. 5 and 6) is pivoted at its center on a pivot pin 40 within the space between the two center plates 31, 31' of H-frame 26, and a link 42, 42' pivoted at each end of spreader bar 38 connects each of the coupling frames 32, 32' to said spreader bar and therefore to each other, such that movement of one is accompanied by an equal movement of the other in the opposite direction.

Figure 6:
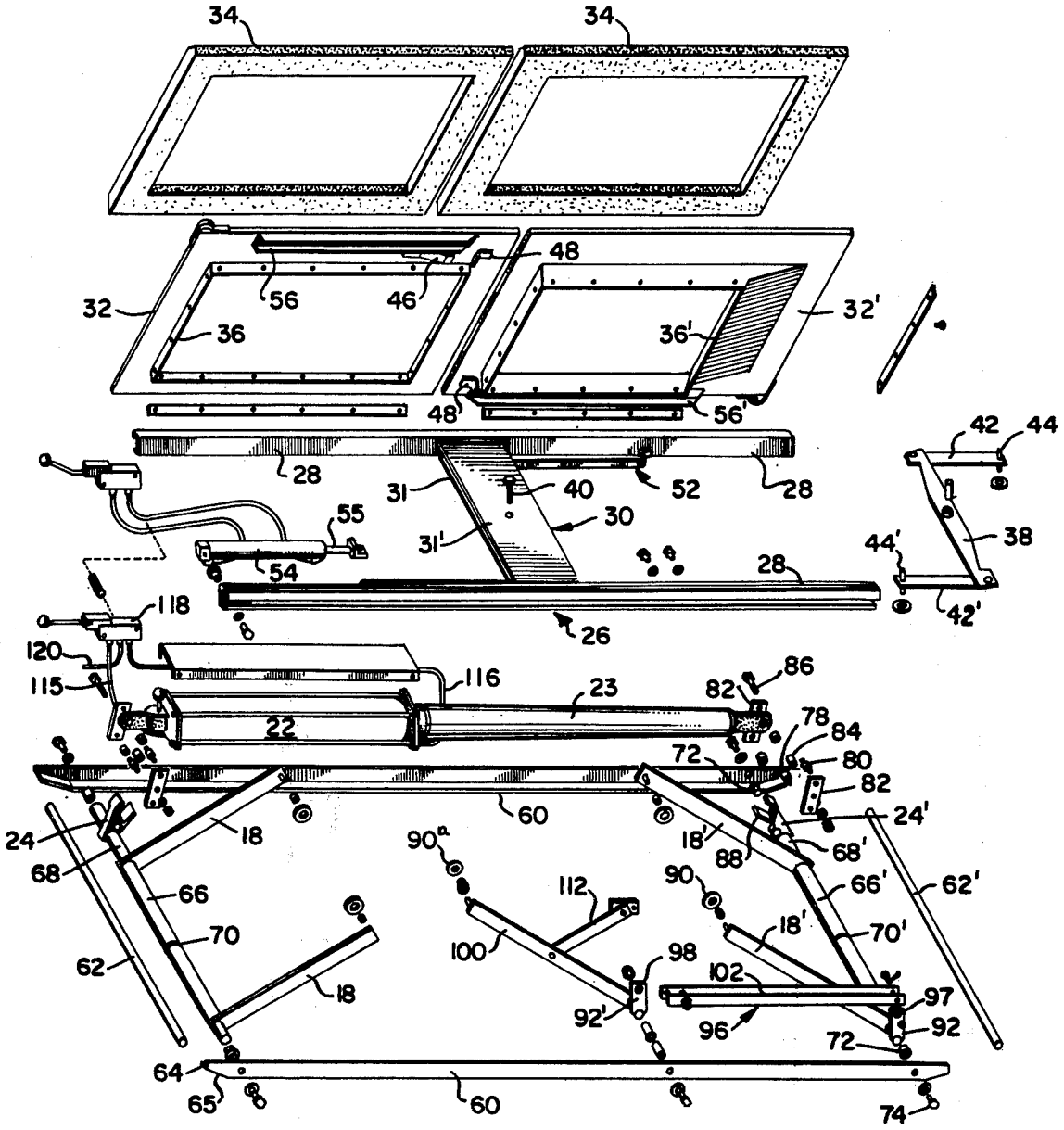
FIG. 6 is an exploded view of the complete unloader apparatus, looking down on the frame and elevating mechanism with the boot-connecting assembly tilted back and with the boots removed in order to expose the construction.

Links 42, 42' extend from spreader bar 38 in opposite directions and are provided at their free ends with fixed pins 44, 44', each of which as shown in FIG. 6 extends both above and below its corresponding link. The upper end of each pin 44, 44' is trapped between two tabs or stops 46 and 48 welded to the underside of each coupling frame 32, 32', so that the frames must move with pivotal movement of spreader bar 38 or when either of them is moved manually. The lower ends of pins 44, 44' are received between a pair of guide rails 50, 50' in slides 52, 52', each welded on the inside of the adjacent channel, 28, 28 and extending outwardly from the cross piece of the H-frame 26.

If desired, an air cylinder 54 may be provided to spread the coupling frames 32, 32' when the left platform is raised and to draw them together so that it can be lowered between the tracks 12. Spreader cylinder 54 is bolted to one of the channels 28 with its piston rod 55 connected to the spreader assembly by means of the upper end of pin 44 on link 42, pin 44 extending upward through a hole in a bracket at the end of piston rod 55 so that it is disposed between stops 46 and 48 on the underside of coupling frame 32. Inverted channels 56, 56' (FIG. 6) are also welded to the underside of the coupling frames 32, 32' adjacent their respective funnel portions 36, 36'. Each of channels 56, 56' is wider than the channels 28, 28 of H-frame 26 and is disposed on its coupling frame 32 or 32' so that it fits over one of the channels 28 when the coupling frame is in place, thereby limiting the coupling frames to movement perpendicular to the track 12.

The fixed frame 20 of the present unloading apparatus consists of a pair of parallel stringers 60, 60, formed from heavy angle iron, the adjacent ends which are connected by fixed journal rods 62, 62'. Stringers 60, 60 are long enough to span the distance between the rails of track 12 so that the ends 64 of the stringers rest on the base flanges of the rails. Since space, or more especially vertical clearance, is a primary consideration in connection with unloader installations, the ends 64 of each of stringers 60, 60 outward of the rods 62, 62' are sloped upward on their undersides in order to lower the frame 20 as much as possible and at the same time provide surface-to-surface contact with both rails 12 on which they rest. To accomplish this, each end 64 is cut back a short distance along the apex of its angle so that, the horizontal flange can be bent upward at about a 15° angle. The lower corner of the vertical flange is also cut at the same angle and then welded to the horizontal flange, forming upwardly inclined mounting surfaces 65 on the lower edges of the stringers at both ends. With the ends 64 of stringers 60, 60 resting on the base flange of the track rails 12, the slope on the mounting surfaces 65 lets the unloader unit as a whole sit somewhat lower between the rails without interfering with the bed of the track or requiring any special support for the unloader other than the track itself. Furthermore, the slope of the mounting surfaces 65 is made to correspond with the outward slope of the track flange, so that the surfaces 65 rest flush on the track flange, thereby facilitating movement of the unloader longitudinally of the track when it is necessary to align it with the outlet of the car.

In the elevating mechanism at one end of the unit, the lifting arms 18', 18' are rigidly mounted, as by welding , at the opposite ends of a torque tube 66' (FIG. 5), through which fits a pivot tube 68' rotatably supported on journal rod 62'. For a reason which will become more apparent hereinafter, torque tube 66' is rigidly fastened, as by welding, to pivot tube 68' only at one point 70' midway between lifting arms 18', 18'. Pivot tube 68', which is longer than torque tube 66', extends outward beyond both ends thereof and is held against movement longitudinally of pivot rod 62' by bushings 72, 72, which are interposed between each of its ends and the vertical flange of the adjacent stringer 60. Assembly bolts 74, 74 extend through stringers 60, 60 and are threaded into each end of journal rod 62' for rigidly securing the stringers 60, 60 thereto.

Figure 2:
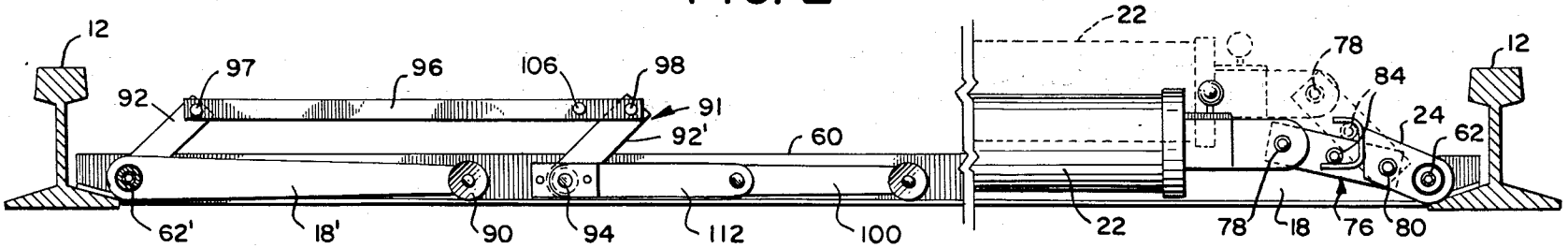
FIG. 2 is a broken side elevational view of only the lifting and leveling linkage for the unloading apparatus of FIG. 1 shown in its fully retracted position with the lift cylinder and crank arm on one side broken away in order to expose the lifting arm and leveling linkage behind.

Referring to FIGS. 1 and 2, the crank-arms 24, 24' at opposite ends of the unit, by which lift cylinder 22 raises lifting arms 18, 18' in a manner similar to that shown in my prior U.S. Pat. No. 3,528,570, are each welded to one end of the corresponding pivot tube 68 68'. Each crank-arm has a hinge 76, 76' pivotally connecting it to lift cylinder 22 by means of hinge pins 78 and 80. In this instance, hinge 76 consists of a pair of parallel side plates 82, 82, disposed on opposite sides of crank-arm 24. Intermediate hinge pins 78 and 80 and between plates 82, 82 is mounted a cylindrical abutment 84 on a bolt 86 extending through both side plates 82, 82. Bolt 86 holds the side plates rigidly together against spacers on hinge pins 78 and 80 in order to allow the hinge 76 to pivot freely about both hinge pins.

Crank-arm 24 extends inward from its pivot tube 68 in generally the same direction as lifting arms 18, 18 and is provided at its inner end with a C-shaped bracket 88, within which the abutment 84 on hinge 76 is disposed for limiting pivotal movement of the hinge about hinge pins 78 and 80. Consequently, when the elevating mechanism is completely retracted, hinge 76 is pivoted to its full-line position shown in FIG. 2 with its abutment 84 engaging the lower flange of bracket 88. Upon extension of lift cylinder 22, hinge 76 pivots upward about its hinge-pin 80 until abutment 84 engages the underside of the upper flange of bracket 88, as shown in broken lines in FIG. 2. This provides the same action that is achieved in the unloader shown in my prior patent, whereby the lift cylinder elevates itself from a retracted position between the rails 12 to a raised position where it has the required mechanical advantage to pivot the lifting arms 18, 18 upward in order to elevate the boot-connecting assembly 10 into engagement with the discharge outlets 16, 16 of the hopper car.

It will be noted that the elevating mechanism at the both sides of the track correspond exactly, each having a torgue tube 66, 66' on which the lifting arms 18, 18' are rigidly mounted, and a pivot tube 68, 68' rigidly connected to its torque tube 66, 66' at the center 70, 70', as well as a hinge 76, 76' by which its crank-arm 24, 24' is connected to the power cylinder 22. It will also be noted that upon expansion of lift cylinder 22, both hinges 76, 76' pivot upward until their central abutments 84, 84' engage the upper flange of the respective brackets 88, 88' on crank-arms 24, 24'. At this point, the force exerted by cylinder 22 is transmitted to crank-arms 24, 24' to pivot lifting arms 18, 18 and 18', 18' upward.

Figures 4, 5:
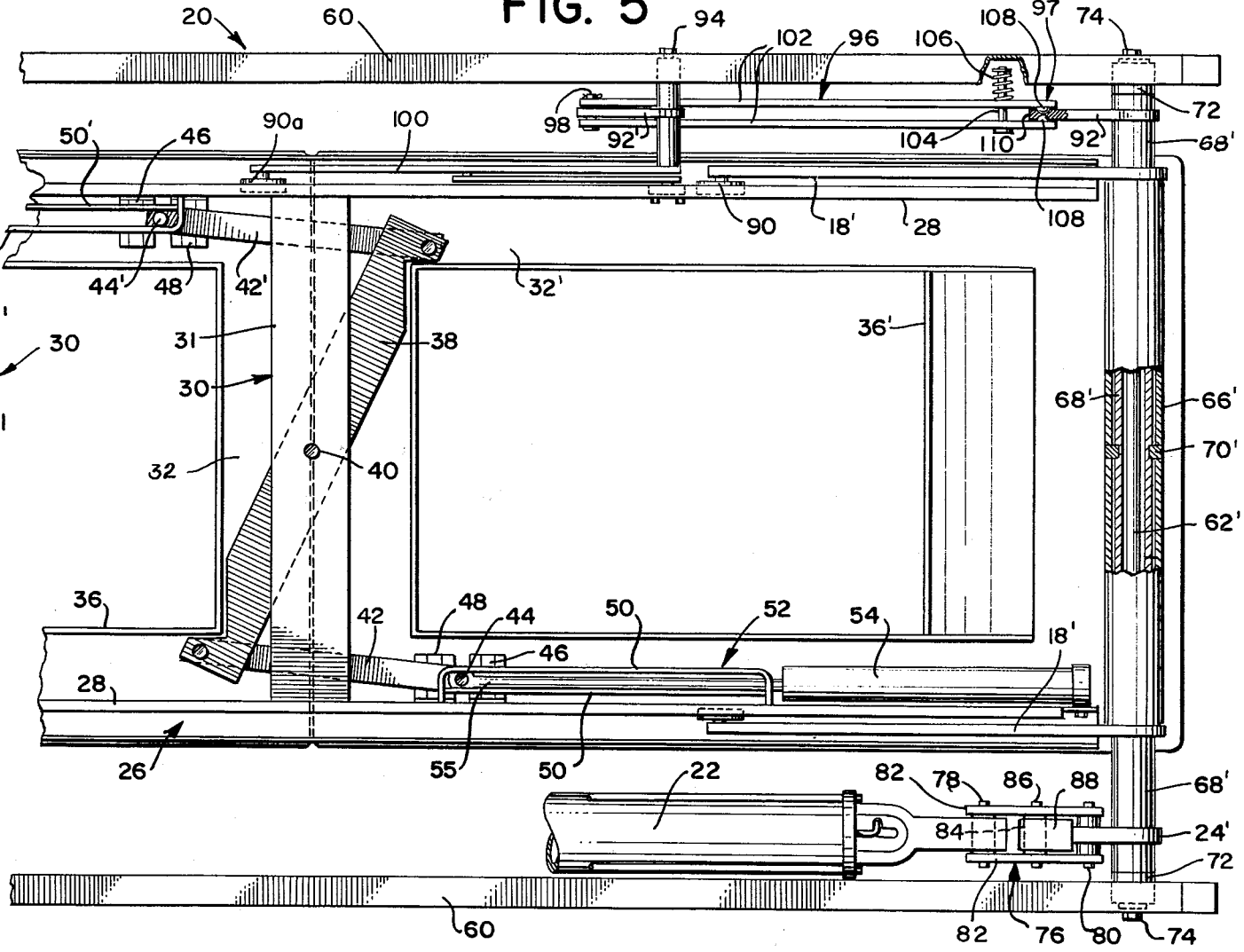
FIG. 4 is a partial vertical section on the line 4—4 of FIG. 3 of only one side of the apparatus and showing the leveling linkage.
FIG. 5 is a bottom plan view of the unloader apparatus shown in FIG. 1, but on a larger scale, with one end of the unit broken away and the flexible boots removed.

The free ends of each of the four lifting arms 18, 18' is provided with a roller 90 on the inner side of each arm. Rollers 90 ride within the channels 28, 28 of the H-frame 26 in boot-connecting assembly 10. As best shown in FIG. 4, channels 28, 28 are C-shaped in cross-section and are disposed so that they open outwardly to receive the rollers 90 of the lifting arms. When lifting arms 18, 18' are pivoted upward upon extension of lift cylinder 22, their outer ends move lengthwise of channels 28, 28, and as will be more apparent hereinafter, means similar to that shown in my prior patent are provided for keeping the boot-connecting assembly 10 as a unit centered between the rails of track 12. In addition, it is also necessary to provide means for preventing the boot-connecting assembly 10 from tilting transversely of track 12 when more resistance to lifting the assembly is encountered by the two sets of lifting arms 18, 18 or 18', 18' at one end of the unit than at the other.

Figure 3:
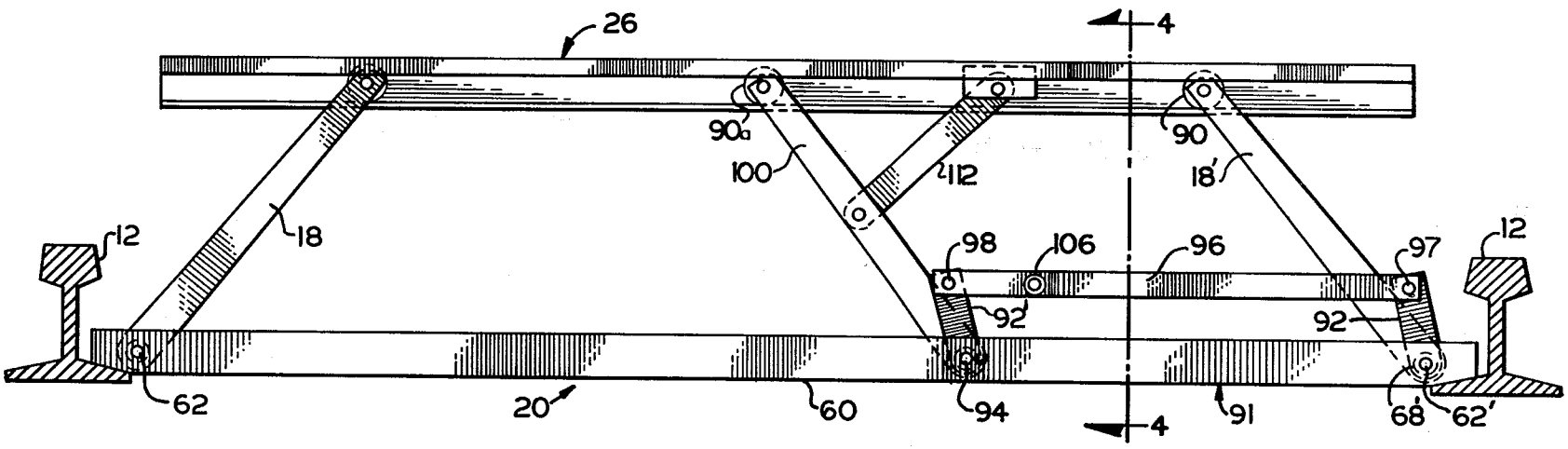
FIG. 3 is another view of the lifting and leveling linkage by itself with the lift cylinder removed and looking at the opposite side of the apparatus from that shown in FIGS. 1 and 2.

A system of links, indicated generally at 91 (FIGS. 2 and 3), is provided in order to form a parallelogram even when the lift platform is completely retracted. The leveling linkage 91 is partly distinct from the lift platform of the unloader, yet is so closely coordinated with it that any movement of the lift platform is followed by a corresponding movement in the linkage 91. To this end, leveling linkage 91 consists of a pair of parallel torque links 92, 92' pivotally mounted in spaced relationship to each other along one of the stringers 60 of the fixed frame 20. One of the links 92 is rigidly mounted on the end of pivot tube 68' of the lifting assembly opposite the crank arm 24', and the other torque link 92' is pivotally mounted on a pivot pin 94 located on stringer 60 approximately one-third of the distance from pivot rod 62' to the opposite pivot rod 62.

A tie-bar 96 is pivotally connected to the free ends of both links 92, 92' such that the distance between its pivot points 97 and 98 is equal to the distance between the pivot pin 94 and pivot rod 62', the distance from pivot point 97 to pivot rod 62' being also equal to the distance from pivot point 98 to pivot pin 94.

Mounted integrally with torque link 92', so that it pivots therewith on pivot pin 94, is a leveling arm 100, which is the same length as the adjacent lifting arm 18' and is disposed at the same angle to torque link 92' that is formed between the torque link 92 and arm 18'. Consequently, leveling arm 100 is maintained parallel with lifting arm 18' by the leveling linkage 91. The free end of traveling arm 100 is provided with a roller 90*a*, which rolls within the C-channel 28 of the H-frame 26.

It will be apparent from the foregoing that the boot-connecting assembly 10 is positively held parallel to the fixed frame 20 by the leveling linkage 91, which forms a parallelogram at all times, due to the fact that torque links 92, 92' are disposed at an angle to the arms 18' and 100, respectively, such that tie-rod 96 is held in an elevated position when the lifting arms 18 are completely retracted.

In order to prevent permanent damage to any of the parts of the apparatus due to excess pressure which may be exerted by the lift cylinder 22 when the boot-connecting platform is held on one side against being raised, while being free to move upward on the other side, it is desirable to provide a safety release against excess bending of the structure. Such a release is readily achieved in the present design simply by providing a releasable connection in the leveling linkage 91 at one end of the tie-bar 96. As best seen in FIG. 5, tie-bar 96 is made up of two parallel bars 102, 102 which straddle the torque links 92, 92'. The pivotal connection 98 between tie-bar 96 and torque link 92' consists of a clevis pin which passes through both bars 102, 102 as well as link 92' and is held in place by means of a cotter pin. The opposite ends of bars 102, 102 are resiliently held together by a spring assembly consisting of a bolt 104, which extends freely through both bars 102, 102 with one end projecting laterally beyond one of the bars 102. A coil spring 106 is placed on the outer end of bolt 104 and held in place by a nut, which may be turned down on bolt 104 in order to increase the pressure exerted by spring 106 on the adjacent bar 102.

Tie-bar 96 is pivotally connected to torque link 92' art 97 by means of a pair of inwardly projecting tapered studs 108, 108, one of studs 108 being mounted on the facing side of each of the bars 102, 102. Studs 108, 108 are normally held within outwardly facing sockets in the opposite ends of a bushing 110 in the outer end of torque link 92', the sockets in bushing 110 into which studs 108, 108 fit being desirably tapered to correspond to the taper of the studs. It will be apparent that upon exertion of a force on tie-bar 96 sufficient to spread bars 102, 102 apart due to the camming action of tapered studs 108, 108 on bushing 110, studs 108, 108 will be forced out of their sockets, breaking the parallelogram and permitting the lift platform of the unloader to drop to one side under the pressure distorting it in that direction. When this occurs, the cause of the difficulty must be determined. This may be, for example, a heavy object resting on one side of the lift platform preventing it from lifting up on that side when the lift cylinder is operated. With the cause of the trouble corrected, the tie-bar 96 may be readily reconnected to the torque link 92' and the unloader again operated normally.

It should be noted that a centering link 112 is pivotally connected at one end to the mid-portion of leveling arm 100 and at its other end to the H-frame 26 of the lift-platform or boot-connecting assembly 10. Centering link 112 simply prevents the lift-platform from moving transversely of the railroad track 12 on the rollers 90 of lifting arms 18, 18' and could, if desired, be mounted on any of the lifting arms, as in the apparatus shown in my prior U.S. Pat. No. 3,528,570.

Power cylinder 22 is a double-acting hydraulically damped pneumatic cylinder having air supply lines 115 and 116 (FIG. 6) connected to a control valve 118 mounted at a suitable control station adjacent the unloading station. Air under pressure is supplied to control valve 118 from a suitable source (not shown) through a supply line 120. Control valve 118 can be operated to furnish air under pressure to either end of cylinder 22 while exhausting the opposite end, thereby raising and lowering the lift-platform.

What is claimed is:

1. In a bulk-unloading apparatus having a lift assembly for connection with a pair of discharge outlets disposed in spaced relation to each other on a vehicle to be unloaded, said lift assembly comprising a platform and a pair of coupling frames supported thereon for movement from a retracted position adjacent each other to a spread position in which said coupling frames are spaced apart for alignment with said discharge outlets, a spreading device for said coupling frames comprising in combination therewith, a spreader bar pivoted intermediate its ends at a fixed point on said platform between said coupling frames, first link means pivotally connecting one end of said spreader bar to one of said coupling frames and second link means pivotally connecting the opposite end of said spreader bar to the other said coupling frame, such that movement of either of said coupling frames on said platform results in a corresponding movement of the other coupling frame in the opposite direction.

2. The combination defined in claim 1, wherein said link means each comprises a rigid member pivoted at one end to said spreader bar and at the other end to one of said coupling frames.

3. The combination defined in claim 2, which further includes power means for spreading and retracting said coupling frames.

4. The combination defined in claim 3, wherein said power means comprises a power cylinder mounted on said platform and connected to one of said coupling frames.

* * * * *